US009512583B1

(12) United States Patent
Spargo

(10) Patent No.: US 9,512,583 B1
(45) Date of Patent: Dec. 6, 2016

(54) HIGH CAPACITY FLOOD PUMP SYSTEM

(71) Applicant: Rick D. Spargo, Hoxie, AR (US)

(72) Inventor: Rick D. Spargo, Hoxie, AR (US)

( * ) Notice: Subject to any disclaimer, the term of this patent is extended or adjusted under 35 U.S.C. 154(b) by 321 days.

(21) Appl. No.: 14/187,836

(22) Filed: Feb. 24, 2014

(51) Int. Cl.

| | |
|---|---|
| ***E02B 3/00*** | (2006.01) |
| ***E02B 8/00*** | (2006.01) |
| ***E02B 7/20*** | (2006.01) |
| ***F04D 27/00*** | (2006.01) |

(52) U.S. Cl.
CPC . *E02B 8/00* (2013.01); *E02B 7/20* (2013.01); *F04D 27/009* (2013.01)

(58) Field of Classification Search
USPC ..... 405/51, 87, 107, 80; 415/72, 73, 220; 416/177, 198 R; 417/313
See application file for complete search history.

(56) References Cited

U.S. PATENT DOCUMENTS

| | | | |
|---|---|---|---|
| 2,174,153 | A | 9/1939 | Dorer |
| 2,222,595 | A | 11/1940 | Regester |
| 2,749,846 | A | 6/1956 | Karrer |
| 2,962,866 | A | 12/1960 | Muehfeld |
| 3,008,422 | A | 11/1961 | Crisafulli |
| 3,017,895 | A | 1/1962 | Portner |
| 3,490,380 | A | 1/1970 | Beckett |
| 3,832,093 | A | 8/1974 | Shirek et al. |
| 4,175,916 | A | 11/1979 | Crisafulli |
| 4,483,509 | A | 11/1984 | Lewcock et al. |
| 5,364,233 | A | 11/1994 | Benoit |
| 6,988,874 | B2 | 1/2006 | Spargo |
| 8,007,249 | B2 | 8/2011 | Spargo |
| 2002/0187054 | A1 | 12/2002 | Eller et al. |
| 2008/0175726 | A1 | 7/2008 | Bartell |

*Primary Examiner* — Sean Andrish

(74) *Attorney, Agent, or Firm* — R. Keith Harrison

(57) ABSTRACT

A high capacity flood pump system includes a floodwater diversion pathway; a pump assembly above the floodwater diversion pathway, the pump assembly including a flood pump having a pump housing with a pump housing inlet and a pump housing outlet; an impeller housing disposed in fluid communication with the pump housing between the pump housing inlet and the pump housing outlet, the impeller housing disposed beneath the pump housing; at least one impeller disposed in the impeller housing; and a power unit drivingly engaging the at least one impeller.

16 Claims, 7 Drawing Sheets

HIGH CAPACITY FLOOD PUMP SYSTEM

CROSS-REFERENCE TO RELATED APPLICATIONS

This application is related to U.S. application Ser. No. 13/065,083, filed Mar. 14, 2011 and entitled "FLOOD PUMP", now U.S. Pat. No. 8,734,092.

FIELD

Illustrative embodiments of the disclosure relate to pumping devices for pumping water from flooded areas. More particularly, illustrative embodiments of the disclosure relate to a high capacity flood pump system which is operable to selectively transport a large volume of water from a flooded area to a river or other outlet.

BACKGROUND

In many areas around the world, levees are constructed along the bank of a river or other water body which has a tendency to flood periodically. The areas outside the levees may be low-lying areas which have a tendency to flood in heavy precipitation. These flood-prone areas may be used for farming or other purposes which may be hampered by a heavy water load. Therefore, it may be necessary to periodically transport a large volume of water from a flood-prone low-lying area and discharge the water into a river or other water body, particularly under flood conditions.

Accordingly, a high-capacity flood pump system which is operable to selectively transport a large volume of water from a flooded area to a river or other outlet is needed.

SUMMARY

The disclosure is generally directed to a high capacity flood pump system which is operable to selectively transport a large volume of water from a flooded area to a river or other outlet. An illustrative embodiment of the high capacity flood pump system includes a floodwater diversion pathway; a pump assembly above the floodwater diversion pathway, the pump assembly including a flood pump having a pump housing with a pump housing inlet and a pump housing outlet; an impeller housing disposed in fluid communication with the pump housing between the pump housing inlet and the pump housing outlet, the impeller housing disposed beneath the pump housing; at least one impeller disposed in the impeller housing; and a power unit drivingly engaging the at least one impeller.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 1:
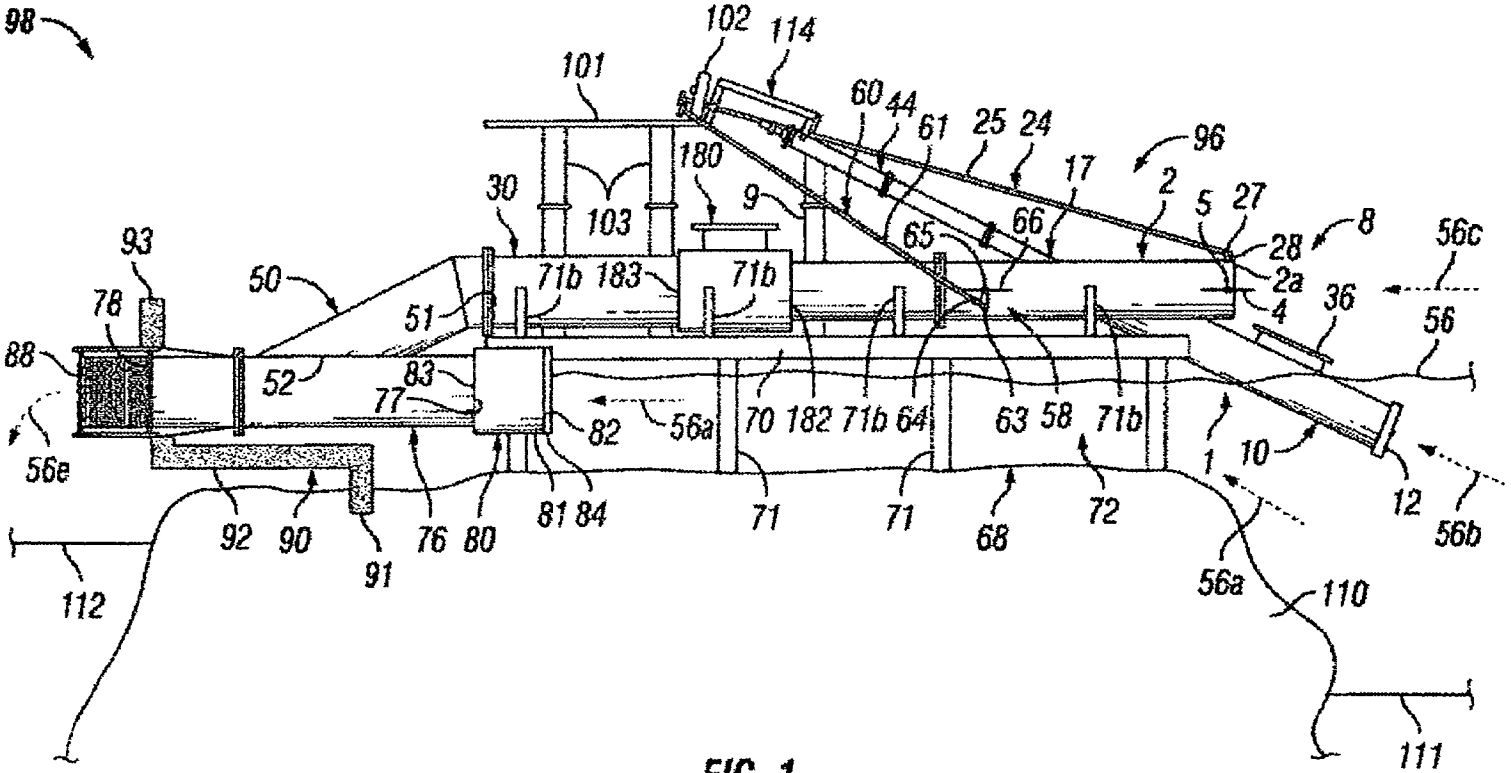
FIG. 1 is a side view of an illustrative embodiment of the high capacity flood pump system in exemplary application of the system.
Figure 1B:
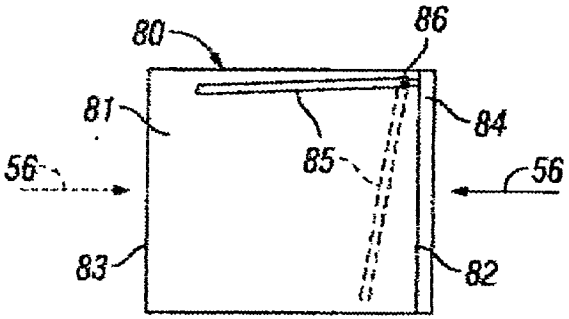
FIG. 1B is a side view of the floodgate illustrated in FIG. 1A, more particularly illustrating an open position (solid lines) and a closed position (phantom lines) of a floodgate door to facilitate flow of floodwater in one direction and block backflow of floodwater in the other direction, respectively, through the floodgate.
Figure 1A:
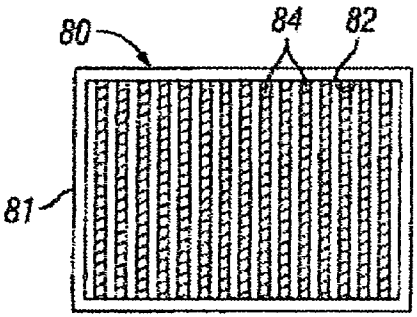
FIG. 1A is a front view of a typical floodgate of an illustrative high capacity flood pump system, taken along viewing lines 1A-1A in FIG. 1.
Figure 1C:
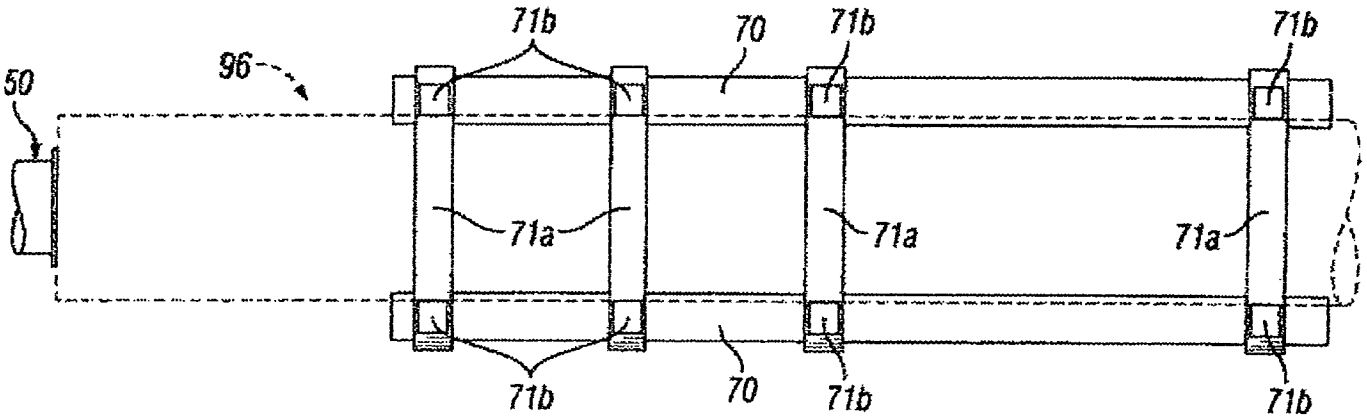
FIG. 1C is a top view of a pair of typical pump support platforms and multiple retaining members upward-standing from the pump support platforms to support a pump assembly on the platforms.

Referring initially to FIGS. 1-6 of the drawings, an illustrative embodiment of the high capacity flood pump system is generally indicated by reference numeral 98 in FIG. 1. In some applications, the high capacity flood pump system 98 may be installed over a levee 110 between a floodplain 111 and a floodwater outlet 112. The floodwater outlet 112 may include a lake, river or other water body or volume which is capable of containing floodwater 56 pumped or discharged from the floodplain 111. As illustrated in FIGS. 1 and 1C, at least one pump support platform 70 may extend over the levee 110. The pump support platforms 70 may be supported by multiple pilings 71 which are upward-standing from the levee 110. As illustrated in FIG. 1C, multiple support members 71*a* may extend between the pump support platforms 70. Multiple retaining members 71*b* may extend upwardly from each pump support platform 70. In some embodiments, four retaining members 71 may extend upwardly from each pump support platform 70 in spaced-apart relationship to each other, as illustrated in FIGS. 1 and 1C. A floodwater diversion pathway 68 may extend over the levee 110 and establish fluid communication between the floodplain 111 and the floodwater outlet 112. The floodwater diversion pathway 68 may include a floodwater diversion space 72 which is formed by and between the levee 110 and the pump support platform 70. The floodwater diversion space 72 may be disposed in fluid communication with the floodplain 111. The floodwater diversion pathway 68 may further include a floodwater diversion conduit 76 which is disposed in fluid communication with the floodwater diversion space 72 and the floodwater outlet 112. As illustrated in FIG. 1 and will be hereinafter described, in typical operation of the high capacity flood pump system 98, the floodwater diversion space 72 and the floodwater diversion conduit 76 divert a first portion 56*a* of the floodwater 56 from the floodplain 111 to the floodwater outlet 112.

The floodwater diversion conduit 76 may have a diversion conduit intake end 77 which is disposed in fluid communication with the floodwater diversion space 72 and a diversion conduit discharge end 78 which is disposed in fluid communication with the floodwater outlet 112. A retaining wall 90 which extends along at least a portion of the levee 110 may support the floodwater diversion conduit 76 over the levee 110. The retaining wall 90 may include an anchor segment 91 which is anchored in the levee 110, an offset segment 92 which extends from the anchor segment 91 toward the floodwater outlet 112 and an diversion conduit mounting segment 93 which extends upwardly from the offset segment 92. The floodwater diversion conduit 76 may extend through a conduit opening (not illustrated) in the diversion conduit mounting segment 93 of the retaining wall 90. A discharge outlet 88 may be provided on the diversion conduit discharge end 78 of the floodwater diversion conduit 76 in fluid communication with the floodwater outlet 112.

In some embodiments, a diversion pathway floodgate 80 may be disposed in fluid communication with the floodwater diversion space 72 and the floodwater diversion conduit 76. As illustrated in FIGS. 1, 1A and 1B, the diversion pathway floodgate 80 may include a floodgate housing 81 which is provided on the diversion conduit intake end 77 of the floodwater diversion conduit 76. The floodgate housing 81 may have a floodgate housing inlet 82 which faces and is disposed in fluid communication with the floodwater diversion space 72 and a floodgate housing outlet 83 which communicates with the diversion conduit intake end 77 of the floodwater diversion conduit 76. As illustrated in FIG. 1A, in some embodiments, multiple floodgate bars 84 may span the floodgate housing inlet 82 of the diversion pathway floodgate 80. Adjacent floodgate bars 84 may be positioned at a spacing of about 1.5" with respect to each other. As illustrated in FIG. 1B, a floodgate door 85 may be pivotally mounted in the floodgate housing 81 via a door pivot 86. Accordingly, the floodgate door 85 may be pivot to an open position (illustrated in solid lines in FIG. 1B) in which floodwater 56 can flow from the floodwater diversion space 72, through the diversion pathway floodgate 80 under the open floodgate door 85 and into the floodwater diversion conduit 76, respectively. Conversely, the floodgate door 85 may pivot to a closed position (illustrated in phantom lines in FIG. 1B) in which the floodgate door 85 blocks backflow of floodwater 56 from the floodwater diversion conduit 76, through the diversion pathway floodgate 80 and into the floodwater diversion space 72, respectively.

As illustrated in FIGS. 2-6, the high capacity flood pump system 98 includes a pump assembly 96 which is supported over the floodwater diversion space 72 (FIG. 1) on the pump support platform 70. As illustrated in FIG. 1 and will be hereinafter further described, in typical operation of the high capacity flood pump system 98, the pump assembly 96 pumps a second portion 56*b* of the floodwater 56 from the floodplain 111 to the floodwater outlet 112. Under the heaviest flood conditions, the pump assembly 96 pumps a third portion 56*c* of the floodwater 56 from the floodplain 111 to the floodwater outlet 112. The pump assembly 96 includes a flood pump 1 which may have a generally elongated pump housing 2 with a pump housing inlet 2*a* which faces the floodplain 111 and a pump housing outlet 2*b* which is opposite the pump housing inlet 2*a*. A pump housing bore 3 (FIG. 4) may extend between the pump housing inlet 2*a* and the pump housing outlet 2*b*. A pump housing flange 6 may terminate the pump housing outlet 2*b* of the pump housing 2. The pump housing flange 6 may have pump flange openings 7 (FIG. 3) to facilitate bolted attachment of the pump housing flange 6 to a drain pipe flange 31 (FIG. 1) of a drain conduit 30 in exemplary application of the flood pump 1 which will be hereinafter described.

Figure 2:
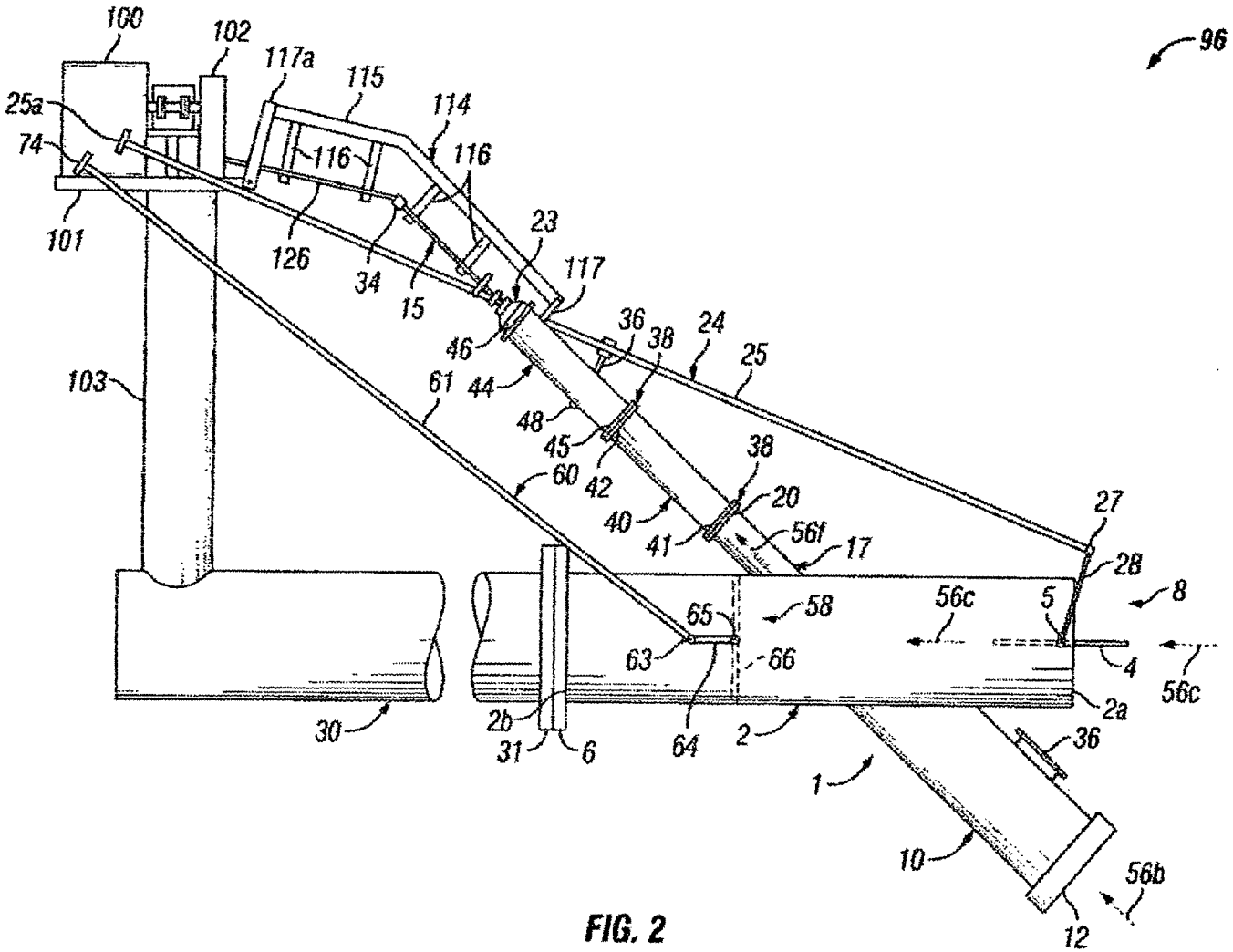
FIG. 2 is a side view of a typical pump assembly of an illustrative high capacity flood pump system, with a pump housing inlet valve and a pump housing outlet valve disposed in open and closed positions, respectively.
Figure 3:
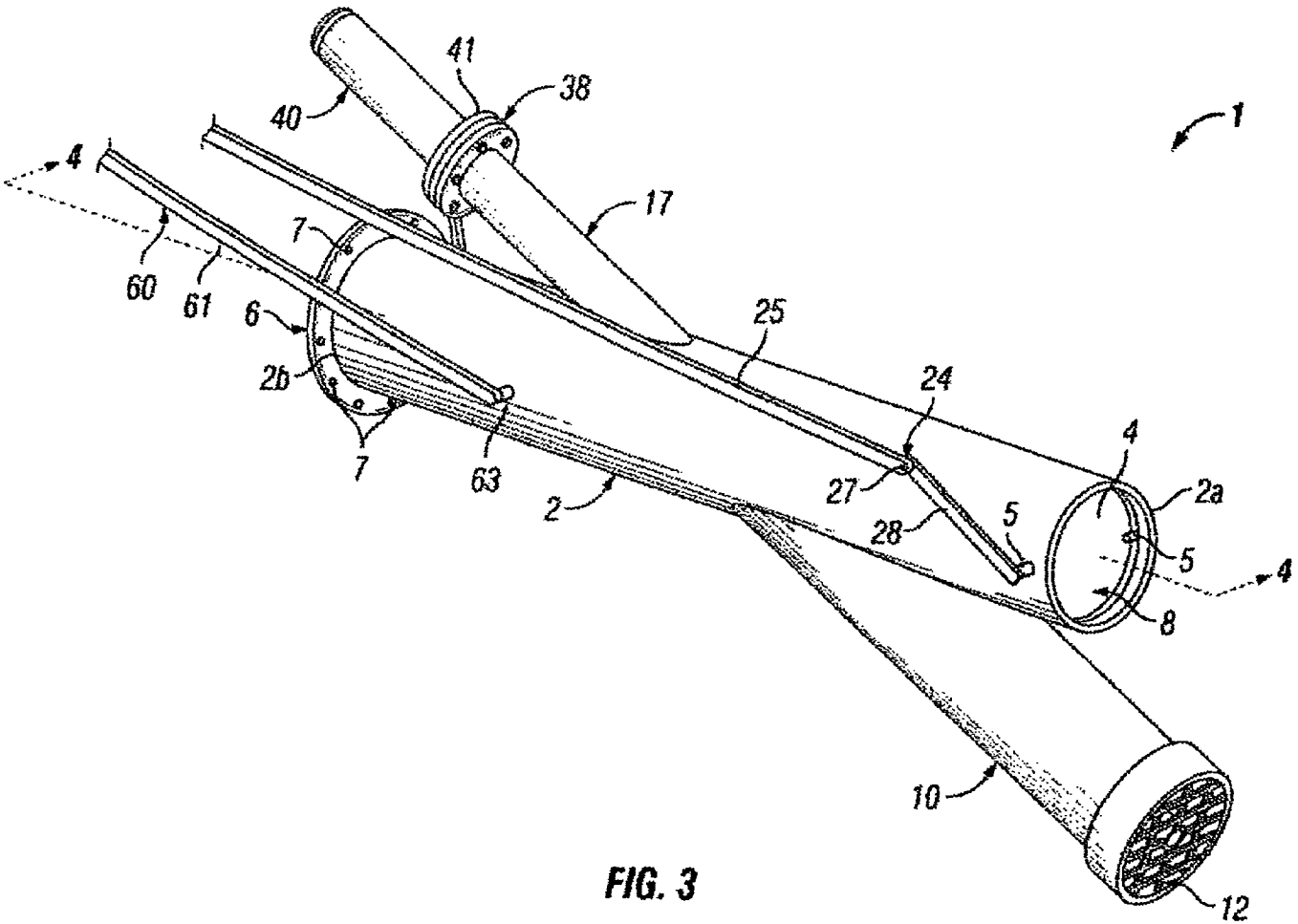
FIG. 3 is a perspective view, partially in section, of a typical flood pump of the pump assembly.
Figure 4:
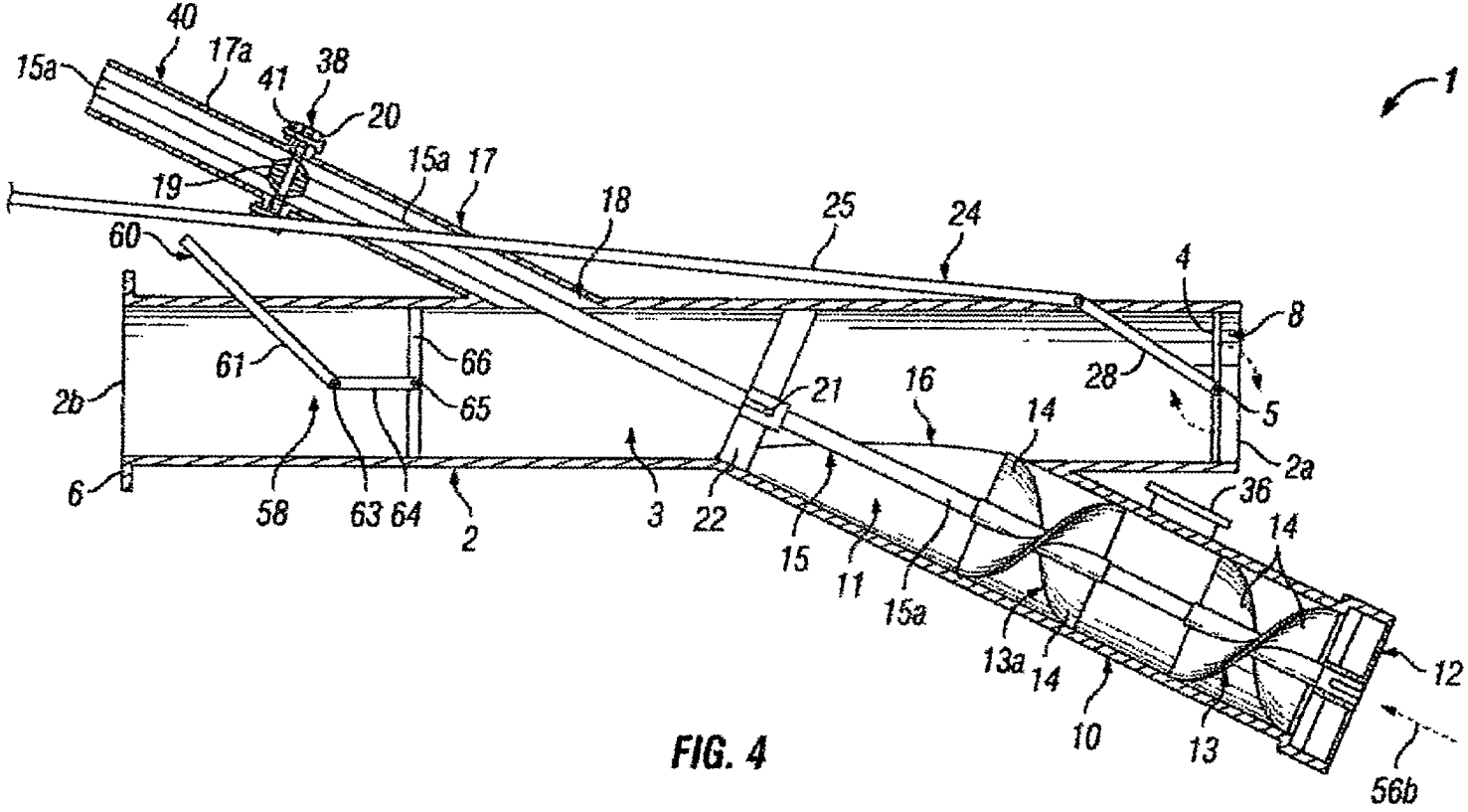
FIG. 4 is a sectional view, taken along section lines 4-4 in FIG. 3, of the flood pump.

As particularly illustrated in FIGS. 2-4, an impeller housing 10 may extend from the pump housing 2. In some embodiments, the impeller housing 10 may extend in angular relationship downwardly and outwardly from the pump housing 2, as illustrated. As illustrated in FIG. 4, the impeller housing 10 may have an impeller housing bore 11 which is disposed in fluid communication with the pump housing bore 3 of the pump housing 2 through an impeller housing discharge opening 16. The impeller housing 10 may terminate in an intake grid 12. As illustrated in FIG. 1, the intake grid 12 is oriented in proximity to the floodplain 111 to serve as an intake for flowing floodwater 56 during operation of the high capacity flood pump system 98 which will be hereinafter described. As further illustrated in FIG. 1, the intake grid 12 may be disposed in front or at the inlet of the floodwater diversion space 72.

As further illustrated in FIGS. 2-4, a shaft housing 17 may extend from the pump housing 2 in substantially aligned relationship to the impeller housing 10. In some embodiments, the shaft housing 17 may extend in angular relationship upwardly and outwardly from the pump housing 2, as illustrated. As illustrated in FIG. 4, the shaft housing 17 may have a shaft housing bore 17*a* which is disposed in fluid communication with the pump housing bore 3 of the pump housing 2 at a shaft housing opening 18. In some embodiments, at least one shaft housing extension 40, 44 may extend from the shaft housing 17. The shaft housing extensions 40, 44 may be joined to the shaft housing 17 and to each other at housing extension joints 38. Accordingly, as illustrated in FIG. 2, a shaft housing flange 20 may terminate the shaft housing 17. The first shaft housing extension 40 may include a first housing extension flange 41 which is attached to the shaft housing flange 20 of the shaft housing 17 using bolts (not illustrated) and a second housing extension flange 42 (FIG. 2) which is spaced-apart from the first housing extension flange 41. The second shaft housing extension 44 may include a first housing extension flange 45 which may be attached to the second housing extension flange 42 of the first shaft housing extension 40 using bolts (not illustrated) and a second housing extension flange 46 which is spaced-apart from the first housing extension flange 45. In some embodiments, at least one water outlet 48 (FIG.

2) may be provided in the second shaft housing extension 44 to facilitate drainage of floodwater 56 from the shaft housing interior 17*a* of the shaft housing 17, as will be hereinafter further described. In some embodiments, at least one pump support 9 may support the shaft housing 17, the first shaft housing extension 40 and/or the second shaft housing extension 44 on the pump support platform 70.

As illustrated in FIG. 4, an impeller shaft 15 may extend through the impeller housing bore 11 of the impeller housing 10 and through the shaft housing bore 17*a* of the shaft housing 17, intersecting the pump housing bore 3 of the pump housing 2. In the pump housing bore 3 of the pump housing 2, the impeller shaft 15 may extend through a marine bearing 21. The marine bearing 21 may be mounted on marine bearing mounts 22 in the pump housing bore 3. In some embodiments, the impeller shaft 15 may be constructed in multiple impeller shaft sections 15*a*. Adjacent impeller shafts 15*a* may be coupled to each other at a flange bearing 19. In some embodiments, the flange bearings 19 may be located generally at the housing extension joints 38 between the first shaft housing extension 40 and the shaft housing 17 and between the second shaft housing extension 44 and the first shaft housing extension 40, respectively. As illustrated in FIG. 2, the impeller shaft 15 may extend from the second shaft housing extension 44 through an upper load bearing 23.

As further illustrated in FIG. 4, at least one impeller 13 having at least one impeller flight 14 may be provided on the impeller shaft 15 in the impeller housing bore 11 of the impeller housing 10. In some embodiments, the flood pump 1 may be a two-stage pump having a first impeller 13 which may be disposed at or adjacent to the intake grid 12 inside the impeller housing 10 and a second impeller 13*a* which may be disposed within or generally adjacent to the impeller housing discharge opening 16. The second impeller 13*a* may be disposed in spaced-apart relationship to the first impeller 13. In some embodiments, the second impeller 13*a* may be disposed at a spacing which corresponds to or lies within the water ejection range of the first impeller 13 at a given operational RPM of the impeller shaft 15. Accordingly, responsive to rotation of the first impeller 13 and the second impeller 13*a* by the impeller shaft 15, the impeller flights 14 pull floodwater 56 into the impeller housing bore 11 through the intake grid 12 as will be hereinafter further described. The second impeller 13*a* is sufficiently spaced from the first impeller 13 to receive the stream of floodwater 56 after it is ejected from the first impeller 13 and eject the stream of floodwater 56 from the impeller housing bore 11 of the impeller housing 10 through the impeller housing discharge opening 16 and into and through the pump housing bore 3 of the pump housing 2 and the drain conduit 30, respectively, of the pump assembly 96. In some non-limiting embodiments, the second impeller 13*a* may be disposed at a spacing of about 48" from the first impeller 13, although this spacing may vary in different embodiments and applications. Operation of the flood pump 1 in exemplary application of the flood pump system 98, which will be hereinafter described, may increase the head pressure of the floodwater 56 to at least 16 feet to ensure timely and efficient evacuation of the floodwater 56 from the floodplain 111. As illustrated in FIGS. 1, 2 and 4, in some embodiments, an inspection hatch 36 may be provided on the impeller housing 10 to facilitate inspection of the impellers 13, 13*a*, the impeller shaft 15 and other components inside the impeller housing bore 11.

As illustrated in FIGS. 2-4, a pump housing inlet valve 8 may be provided in the pump housing bore 3 generally at the pump housing inlet 2*a*. In some embodiments, the pump housing inlet valve 8 may include a flapper valve disk 4 which can be selectively oriented in a closed position, as illustrated in FIGS. 3 and 4, in which the plane of the flapper valve disk 4 is disposed in generally perpendicular relationship with respect to flow of floodwater 56 through the pump housing bore 3, as will be hereinafter described. In the closed position, the flapper valve disk 4 may substantially prevent flow of floodwater 56 into the pump housing bore 3 through the pump housing inlet 2*a*. Alternatively, the flapper valve disk 4 of the pump housing inlet valve 8 may be selectively oriented in an open position, as illustrated in FIGS. 1 and 2, in which the plane of the flapper valve disk 4 is disposed in parallel relationship with respect to the flow of floodwater 56 through the pump housing bore 3. In the open position, the flapper valve disk 4 may facilitate substantially unhindered flow of floodwater 56 into the pump housing bore 3 through the pump housing inlet 2*a*.

An inlet valve control 24 may operably engage the pump housing inlet valve 8 to facilitate selective opening and closing of the pump housing inlet valve 8. As illustrated in FIGS. 2 and 4, in some embodiments, the inlet valve control 24 may include a flapper valve connecting rod 28 which is pivotally attached to the flapper valve disk 4 at a flapper valve pin 5. A generally elongated flapper valve control rod 25 may pivotally engage the flapper valve connecting rod 28 at a control handle pivot 27. As illustrated in FIG. 1, a control rod grip 25*a* may terminate the flapper valve control rod 25. Accordingly, an operator (not illustrated) may grasp the control rod grip 25*a* and push the flapper valve control rod 25 such that the flapper valve control rod 25 pivots the flapper valve connecting rod 28 at the control handle pivot 27 and pivots the flapper valve disk 4 to the open position illustrated in FIGS. 1 and 2. Conversely, the operator may pull the flapper valve control rod 25 such that the flapper valve disk 4 is pivoted to the closed position illustrated in FIGS. 3 and 4.

As further illustrated in FIGS. 1-4, a pump housing outlet valve 58 may be provided in the pump housing bore 3 generally at or adjacent to the pump housing outlet 2*b*. In some embodiments, the pump housing outlet valve 58 may include a flapper valve disk 66 which can be selectively oriented in a closed position, as illustrated in FIGS. 2 and 4, in which the plane of the flapper valve disk 66 is disposed in generally perpendicular relationship with respect to flow of floodwater 56 through the pump housing bore 3, as will be hereinafter described. In the closed position, the flapper valve disk 66 may substantially prevent flow of floodwater 56 from the pump housing bore 3 through the pump housing outlet 2*b*. Additionally, as illustrated in FIG. 2, the closed flapper valve disk 66 may divert a portion 56*f* of the floodwater 56 from the pump housing bore 3 (FIG. 4) of the pump housing 2 into the shaft housing bore 17*a* of the shaft housing 17. Alternatively, the flapper valve disk 66 of the pump housing outlet valve 58 may be selectively oriented in an open position, as illustrated in FIG. 1, in which the plane of the flapper valve disk 66 is disposed in generally parallel relationship with respect to the flow of floodwater 56 through the pump housing bore 3. In the open position, the flapper valve disk 66 may facilitate substantially unhindered flow of floodwater 56 from the pump housing bore 3 through the pump housing outlet 2*b* and into and through the drain conduit 30.

An outlet valve control 60 may operably engage the pump housing outlet valve 58 to facilitate selective opening and closing of the pump housing outlet valve 58. In some embodiments, the outlet valve control 60 may include a flapper valve connecting rod 64 which is pivotally attached to the flapper valve disk 66 at a flapper valve pin 65. A generally elongated flapper valve control rod 61 may pivotally engage the flapper valve connecting rod 64 at a control handle pivot 63. Accordingly, an operator (not illustrated) may grasp the control rod grip 74 and push the flapper valve control rod 61 such that the flapper valve control rod 61 pivots the flapper valve connecting rod 64 at the control handle pivot 63 and pivots the flapper valve disk 66 to the open position illustrated in FIG. 1. Conversely, the operator may pull the flapper valve control rod 61 such that the flapper valve disk 66 is pivoted to the closed position illustrated in FIG. 4.

As illustrated in FIG. 2, a power unit 100 may drivingly engage the impeller shaft 15 in the shaft housing bore 17*a* (FIG. 5) of the shaft housing 17. In some embodiments, an impeller shaft extension 126 may be drivingly coupled to the impeller shaft 15 at a universal joint 34. The power unit 100 may drivingly engage the impeller shaft extension 126 through a gear box 102. The power unit 100 and the gear box 102 may be provided on a power unit stand 101 which may be elevated over the drain conduit 30 to which the pump housing 2 is attached. In some embodiments, a vertical stand support 103 may be upward-standing from the drain conduit 30. The power unit stand 101 may be supported by the stand support 103.

Figure 5:
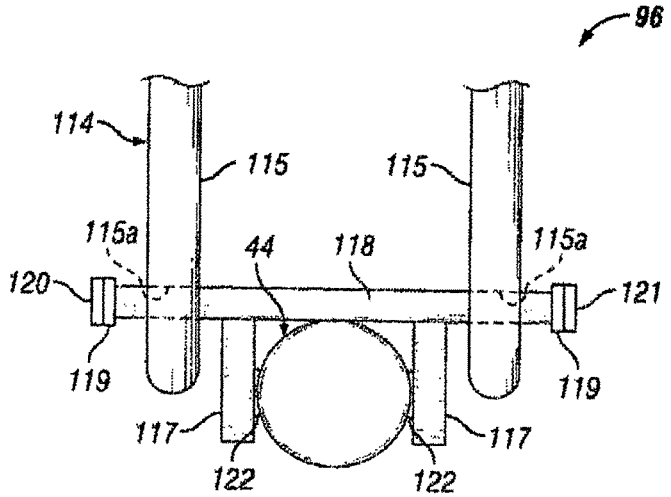
FIG. 5 is a top view of a portion of the pump assembly, more particularly illustrating exemplary attachment of a driveline safety cage to a shaft housing extension of the shaft housing.
Figure 6:
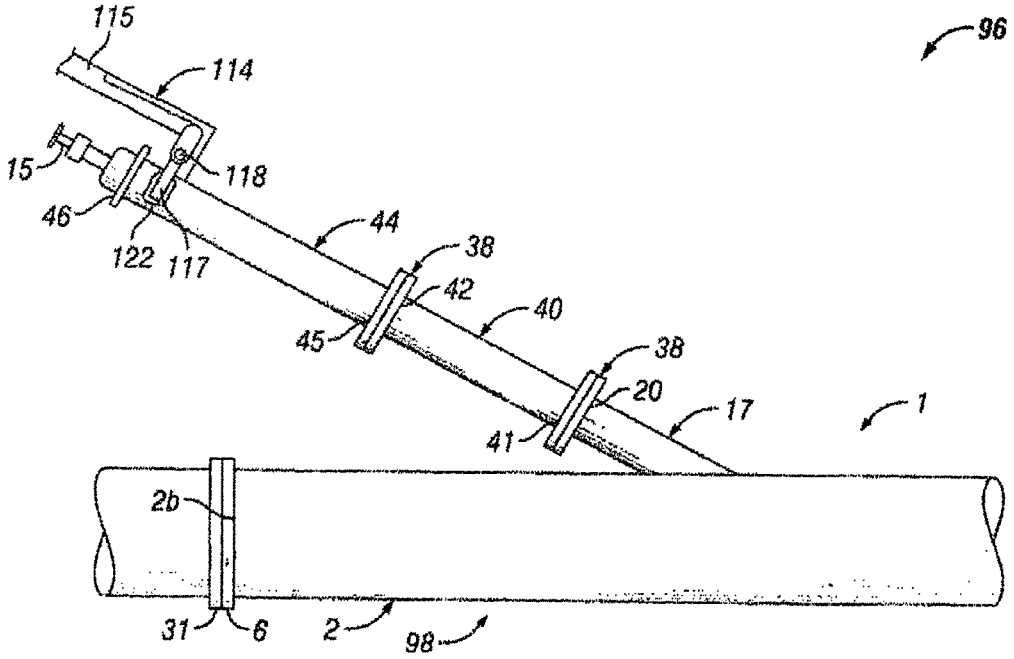
FIG. 6 is a side view, partially in section, of a portion of the pump assembly, with a driveline safety cage (partially in section) attached to a shaft housing extension of a shaft housing on the pump assembly.

A driveline safety cage 114 may extend over the impeller shaft 15, the universal joint 34 and the impeller shaft extension 126. The driveline safety cage 114 may include a pair of generally elongated, parallel, spaced-apart safety cage frames 115 (FIG. 5). A pair of lower end frame supports 117 may attach the safety cage frames 115 to the second shaft housing extension 44. A pair of upper end frame supports 117*a* (one of which is illustrated in FIG. 2) may attach the safety cage frames 115 to the power unit stand 101. As illustrated in FIG. 5, in some embodiments, a safety cage bolt 118 having a bolt head 120 may be extended through a pair of aligned bolt openings 115*a* in the respective safety cage frames 115. Lock washers 119 may be provided on respective ends of the safety cage bolt 118. A securing nut 121 may be threaded on the safety cage bolt 118. A pair of spaced-apart lower end frame supports 117 may extend downwardly from the safety cage bolt 118. The lower end frame supports 117 may be attached to the second shall housing extension 44 at a pair of welds 122. As illustrated in FIG. 2, in some embodiments, multiple shaft guards 116 may extend from the safety cage frames 115 and may be generally juxtaposed to the impeller shaft 15 and the impeller shaft extension 126 for protection purposes.

As illustrated in FIG. 1, a connecting conduit 50 may connect the drain conduit 30 of the pump assembly 96 to the floodwater diversion conduit 76. The connecting conduit 50 may have a connecting conduit inlet 51 which is disposed in fluid communication with the drain pipe outlet 31*b* of the drain conduit 30 and a connecting conduit outlet 52 which is disposed in fluid communication with the floodwater diversion conduit 76. Accordingly, the connecting conduit 50 may slope or angle downwardly from the drain conduit 30 to the floodwater diversion conduit 76.

Figure 2A:
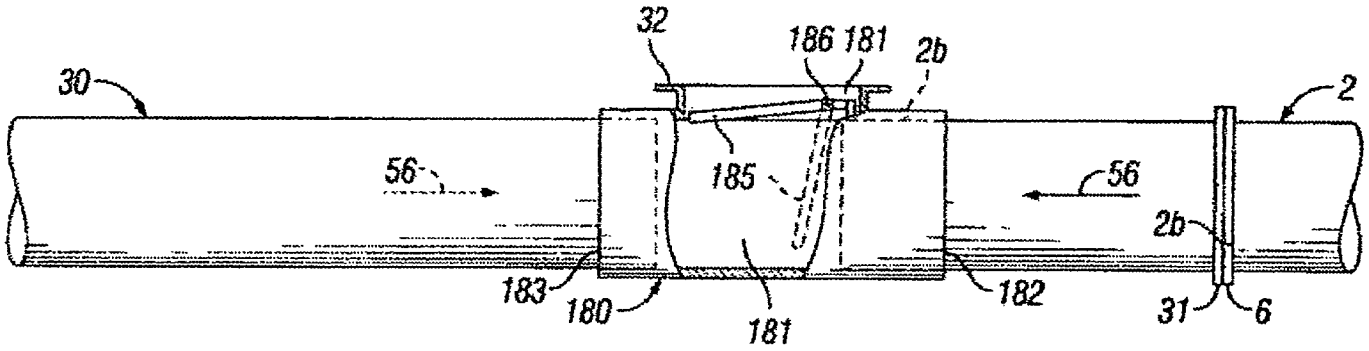
FIG. 2A is a side view, partially in section, of a floodgate between a pump housing of a flood pump and a drain conduit of the pump assembly, more particularly illustrating an open position (solid lines) and a closed position (phantom lines) of a floodgate door to facilitate flow of floodwater in one direction and block backflow of floodwater in the other direction, respectively, through the floodgate.

As illustrated in FIG. 2A, in some embodiments, a pump assembly floodgate 180 may be provided between the pump housing 2 of the flood pump 1 and the drain conduit 30 of the pump assembly 96. The pump assembly floodgate 180 may include a floodgate housing 181 having a floodgate housing inlet 182 which faces and is disposed in fluid communication with the pump housing 2 and a floodgate housing outlet 183 which faces and is disposed in fluid communication with the drain conduit 30. In some embodiments, multiple floodgate bars (not illustrated) may span the floodgate housing inlet 182 of the pump assembly floodgate 180. A floodgate door 185 may be pivotally mounted in the floodgate housing 181 via a door pivot 186. Accordingly, the floodgate door 185 may be pivot to an open position (illustrated in solid lines in FIG. 2A) in which floodwater 56 can flow from the pump housing 2, through the pump assembly floodgate 180 under the open floodgate door 185 and into the drain conduit 30, respectively. Conversely, the floodgate door 185 may pivot to a closed position (illustrated in phantom lines in FIG. 2A) in which the floodgate door 185 blocks backflow of floodwater 56 from the drain conduit 30, through the pump assembly floodgate 180 and into the pump housing 2, respectively. A inspection hatch 32 may be provided in the drain conduit 30 for the purpose of inspecting the interior of the drain conduit 30 and/or the pump housing 2 such as the pump assembly floodgate 180 for repair, replacement, cleaning and maintenance purposes.

Referring again to FIG. 1 of the drawings, in exemplary application, the high capacity flood pump system 98 is installed on a levee 110 adjacent to a river, lake or other floodwater outlet 112 to pump floodwater 56 typically from a low-lying area such as a floodplain 111 adjacent to the floodwater outlet 112 and discharge the drained floodwater 56 into the floodwater outlet 112. Under moderate precipitation conditions, the floodwater 56 may rise on the floodplain 111 to the floodwater diversion space 72 between the levee 110 and the pump support platform 70. Accordingly, the first portion 56*a* of floodwater 56 flows by gravity from the floodplain 111 through the floodwater diversion space 72, the diversion pathway floodgate 80, the floodwater diversion conduit 76 and the discharge outlet 88, respectively, from which discharged floodwater 56*e* flows into the floodwater outlet 112. As illustrated in FIG. 1B, the floodgate door 85 of the diversion pathway floodgate 80 is disposed in the open position indicated by the solid lines in FIG. 1B as the first portion 56*a* of the floodwater 56 flows from the floodwater diversion space 72 through the diversion pathway floodgate 80 into the floodwater outlet 112.

Under heavy precipitation conditions, the first portion 56*a* of the floodwater 56 flows from the floodplain 111 to the floodwater outlet 112 by gravity through the floodwater diversion space 72, the diversion pathway floodgate 80 and the floodwater diversion conduit 76, respectively, as described above. In the event that the floodwater 56 on the floodplain 111 reaches or submerges the intake grid 12 on the impeller housing 10 of the flood pump 1, the flood pump 1 is operated to pump a second portion 56*b* of the floodwater 56 through the impeller housing 10 and the pump housing 2, respectively, of the flood pump 1 and then through the pump assembly floodgate 180, the drain conduit 30 and the connecting conduit 50 into the floodwater diversion conduit 76, respectively. In the floodwater diversion conduit 76, the second portion 56*b* mixes with the first portion 56*a* of the floodwater 56 and is discharged from the discharge outlet 88 into the floodwater outlet 112 as the discharged floodwater 56*e*.

In operation of the flood pump 1, the power unit 100 (FIG. 2) is operated to rotate the impeller shaft 15 in the impeller housing bore 11 (FIG. 4) of the impeller housing 10 through the gear box 102, the impeller shaft extension 126 and the universal coupling 34. The impeller shaft 15 rotates the impellers 13, 13*a* (FIG. 4) in the impeller housing bore 11 of the impeller housing 10. Accordingly, the impeller flights 14 of the impellers 13, 13*a* draw the second portion 56*b* of the floodwater 56 through the intake grid 12 into the impeller housing bore 11. The second portion 56*b* of the floodwater 56 flows from the impeller housing bore 11 through the impeller housing discharge opening 16 into the pump housing bore 3.

In some applications, the second portion 56*b* of the floodwater 56 flows from the pump housing bore 3 through the drain conduit 30 and into the connecting conduit 50 and floodwater diversion conduit 76, respectively. Accordingly, prior to operation of the flood pump 1, the outlet valve control 60 is operated to orient the flapper valve disk 66 of the pump housing outlet valve 58 in the horizontal position illustrated in FIG. 1. The horizontal flapper valve disk 66 facilitates substantially unimpeded flow of the pumped floodwater 56 through the pump housing bore 3 of the pump housing 2 and into and through the drain conduit 30.

In some applications, a stream 56*f* (FIG. 2) of the second portion 56*b* of the floodwater 56 is diverted from the pump housing bore 3 of the pump housing 2 through the shaft housing opening 18 (FIG. 4) and into the shaft housing interior 17*a* of the shaft housing 17. Therefore, the diverted stream 56*f* of the second portion 56*b* of the floodwater 56 cools the flange bearings 19 in which the impeller shaft 15 rotates during operation of the flood pump 1. In some embodiments, at least one water outlet 48 (FIG. 2) may be provided in the shaft housing 17 to facilitate drainage of the diverted stream 56*f* of the pumped floodwater 56*b* from the shaft housing interior 17*a* of the shaft housing 17.

Under the heaviest precipitating and flooding conditions in which the floodwater 56 which is being removed from the floodplain 111 has a depth which equals or exceeds the depth of the pump housing inlet 2*a* of the pump housing 2, or under circumstances in which the water is to be drained into the pump housing bore 3 of the pump housing 2 by gravity, the inlet valve control 24 may be manipulated to open the flapper valve disk 4 of the pump housing inlet valve 8 to the horizontal open position illustrated in FIG. 1. Accordingly, a third portion 56*c* of the floodwater 56 may flow into the pump housing bore 3 of the pump housing 2 through the pump housing inlet 2*a*. In applications in which the pump housing outlet valve 58 is in the open position as illustrated in FIG. 1, the third portion 56*c* of the floodwater 56 flows from the pump housing bore 3 through the pump assembly floodgate 180, the drain conduit 30 and the connecting conduit 50, respectively, into and through the floodwater diversion conduit 76. As illustrated in FIG. 2A, the floodgate door 185 of the pump assembly floodgate 180 is disposed in the open position indicated by the solid lines as the third portion 56*c* of the floodwater 56 flows from the pump housing 2 of the flood pump 1 through the pump assembly floodgate 180 into the drain conduit 30.

In the floodwater diversion conduit 76, the third portion 56*c* may mix with the first portion 56*a* and the second portion 56*b* of the floodwater 56 and is discharged from the discharge outlet 88 into the floodwater outlet 112 as discharged floodwater 56*e*. In applications in which the pump housing outlet valve 58 is in the closed position as illustrated in FIG. 2, the third portion 56*c* of the floodwater 56 is diverted from the pump housing bore 3 into the shaft housing bore 17*a* of the shaft housing 17 as a diverted stream 56*f*, as was heretofore described. In the foregoing manner, the high capacity flood pump system 98 is operable to effectively transfer a large quantity or volume of floodwater 56 from the floodplain 111 to the floodwater outlet 112 under moderate, heavy and flooding precipitation conditions.

It will be appreciated by those skilled in the art that the high capacity flood pump system 1 provides enhanced security against backflow of water 56 from the floodwater outlet 112 to the floodplain 111 over conventional floodwater diversion systems. Referring again to FIG. 1B of the drawings, backpressure in the floodwater diversion conduit 76 (FIG. 1) of the floodwater diversion pathway 68 causes the floodgate door 85 to pivot from the open position indicated by the solid lines to the closed position indicated by the phantom lines in the floodgate housing 81 of the diversion pathway floodgate 80. As illustrated in FIG. 2A, backpressure in the drain conduit 30 of the pump assembly 96 causes the floodgate door 185 to pivot from the open position indicated by the solid lines to the closed position indicated by the phantom lines in the floodgate housing 181 of the pump assembly floodgate 180. Accordingly, the diversion pathway floodgate 80 and the pump assembly floodgate 180 prevent backflow of floodwater 56 from the floodwater outlet 112 to the floodplain 111.

The high capacity flood pump system 98 is capable of removing a large quantity or volume of water from a floodplain 111 to a floodwater outlet 112 under the heaviest precipitation and flood conditions. Multiple high capacity flood pump systems 98 can be spaced at selected intervals along a river or other floodwater outlet 112 to provide sufficient floodwater removal capability for drainage districts and municipalities located on the floodplain 111. In some applications, a selected number of high capacity flood pump systems 98 can be installed at selected intervals with respect to each other along the retaining wall 90 to remove floodwater 56 from a floodplain 111 having a considerable area. It will be further appreciated by those skilled in the art that the elevated position of the flood pump 1 relative to the floodplain 111 prevents suction of silt from the floodplain 111 and consequent formation of sinkholes which may otherwise have a tendency to form in the levee 110 and divert floodwater 56 from the floodwater outlet 112 back to the floodplain 111.

While various illustrative embodiments of the disclosure have been described above, it will be recognized and understood that various modifications can be made in the disclosure and the appended claims are intended to cover all such modifications which may fall within the spirit and scope of the embodiments of the disclosure.

What is claimed is:

1. A high capacity flood pump system, comprising:

a pump support platform;

a floodwater diversion pathway beneath the pump support platform;

a pump assembly carried by the pump support platform above the floodwater diversion pathway, the pump assembly including:

a flood pump having a pump housing;

an impeller housing disposed in fluid communication with the pump housing, the impeller housing disposed beneath the pump housing;

at least one impeller disposed in the impeller housing; and a power unit drivingly engaging the at least one impeller;

the floodwater diversion pathway including a floodwater diversion conduit, a pump housing outlet of the pump housing is disposed in fluid communication with the floodwater diversion conduit; and a connecting conduit establishing fluid communication between the pump housing of the flood pump and the floodwater diversion conduit.

2. The high capacity flood pump system of claim 1 further comprising a drain conduit disposed in fluid communication with the pump housing and the connecting conduit.

3. The high capacity flood pump system of claim 1 further comprising a floodwater diversion space disposed in fluid communication with the floodwater diversion conduit.

4. The high capacity flood pump system of claim 3 further comprising a diversion pathway floodgate between the floodwater diversion conduit and the floodwater diversion space.

5. The high capacity flood pump system of claim 4 further comprising a discharge outlet terminating the floodwater diversion conduit.

6. The high capacity flood pump system of claim 3 wherein the impeller housing is disposed at an inlet of the floodwater diversion pathway.

7. A high capacity flood pump system, comprising:

a pump support platform;

a floodwater diversion pathway beneath the pump support platform;

a pump assembly carried by the pump support platform above the floodwater diversion pathway, the pump assembly including:

a flood pump having a pump housing with a pump housing inlet and a pump housing outlet;

an impeller housing disposed in fluid communication with the pump housing between the pump housing inlet and the pump housing outlet, the impeller housing disposed beneath the pump housing;

at least one impeller disposed in the impeller housing; and a power unit drivingly engaging the at least one impeller;

the floodwater diversion pathway including a floodwater diversion conduit, the pump housing outlet of the pump housing is disposed in fluid communication with the floodwater diversion conduit; and a sloped connecting conduit establishing fluid communication between the pump housing of the flood pump and the floodwater diversion conduit.

8. The high capacity flood pump system of claim 7 further comprising a drain conduit disposed in fluid communication with the pump housing outlet of the pump housing and the connecting conduit.

9. The high capacity flood pump system of claim 7 further comprising a floodwater diversion space disposed in fluid communication with the floodwater diversion conduit.

10. A high capacity flood pump system, comprising:

a pump support platform;

a floodwater diversion pathway beneath the pump support platform;

a pump assembly carried by the pump support platform above the floodwater diversion pathway, the pump assembly including:

a flood pump having a pump housing with a pump housing inlet and a pump housing outlet;

an impeller housing disposed in fluid communication with the pump housing between the pump housing inlet and the pump housing outlet, the impeller housing disposed beneath the pump housing;

at least one impeller disposed in the impeller housing; and a power unit drivingly engaging the at least one impeller;

the floodwater diversion pathway includes a floodwater diversion conduit, the pump housing outlet of the pump housing is disposed in fluid communication with the floodwater diversion conduit;

a floodwater diversion space disposed in fluid communication with the floodwater diversion conduit; and a diversion pathway floodgate between the floodwater diversion conduit and the floodwater diversion space.

11. The high capacity flood pump system of claim 10 further comprising a discharge outlet terminating the floodwater diversion conduit.

12. The high capacity flood pump system of claim 10 wherein the impeller housing is disposed at an inlet of the floodwater diversion pathway.

13. A high capacity flood pump system for displacing floodwater from a floodplain to a floodwater outlet, comprising:

a levee;

a pump support platform carried by and elevated with respect to the levee;

a floodwater diversion pathway including:

a floodwater diversion space between the levee and the pump support platform, the floodwater diversion space positioned for fluid communication with the floodplain; and a floodwater diversion conduit disposed in fluid communication with the floodwater diversion space, the floodwater diversion conduit positioned for fluid communication with the floodwater outlet;

a pump assembly carried by the pump support platform above the floodwater diversion pathway, the pump assembly including:

a flood pump having a pump housing with a pump housing inlet positioned for fluid communication with the floodplain above the floodwater diversion space and a pump housing outlet opposite the pump housing inlet;

an impeller housing disposed in fluid communication with the pump housing between the pump housing inlet and the pump housing outlet, the impeller housing disposed beneath the pump housing and positioned for fluid communication with the floodplain generally between the floodwater diversion space of the floodwater diversion pathway and the pump housing inlet of the pump housing of the flood pump;

a first impeller disposed in the impeller housing;

a second impeller disposed in the impeller housing in spaced-apart relationship to the first impeller;

a power unit drivingly engaging the first impeller and the second impeller;

a drain conduit disposed in fluid communication with the pump housing outlet of the pump housing of the flood pump; and a sloped connecting conduit establishing fluid communication between the drain conduit and the floodwater diversion conduit of the floodwater diversion pathway.

14. The high capacity flood pump system of claim 13 further comprising a diversion pathway floodgate between the floodwater diversion conduit and the floodwater diversion space of the floodwater diversion pathway and a pump assembly floodgate between the pump housing of the flood pump and the drain conduit of the pump assembly.

15. The high capacity flood pump system of claim 13 further comprising a discharge outlet terminating the floodwater diversion conduit.

16. The high capacity flood pump system of claim 13 wherein the impeller housing is disposed at an inlet of the floodwater diversion pathway.

* * * * *